US006341906B2

(12) United States Patent
Kobayashi et al.

(10) Patent No.: US 6,341,906 B2
(45) **Date of Patent: *Jan. 29, 2002**

(54) CASSETTE CONTAINING MAGNETICALLY AFFIXABLE PRINTING TAPE AND TAPE PRINTER WHICH USE THE CASSETTE

(75) Inventors: Kenji Kobayashi, Akiruno; Kenzo Ito, Kodaira; Kenji Igarashi, Tokyo; Masayuki Ikeda, Kawaguchi; Kensaku Takeuchi, Kokubunji; Kenji Suyama, Ome; Satoshi Kimura, Ome; Koji Deguchi, Ome, all of (JP)

(73) Assignee: Casio Computer Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/395,657

(22) Filed: Sep. 14, 1999

(30) Foreign Application Priority Data

Sep. 21, 1998 (JP) ..... 10-266941
Oct. 2, 1998 (JP) ..... 10-281756

(51) Int. Cl.[7] ..... B41J 35/28
(52) U.S. Cl. ..... 400/207; 400/241
(58) Field of Search ..... 400/207, 241, 400/240, 241.1, 223, 239, 237, 4, 5, 224.2, 245

(56) References Cited

U.S. PATENT DOCUMENTS 2,791,312 A * 5/1957 Coffman ..... 400/241
3,633,720 A * 1/1972 Tyler ..... 197/1
3,665,115 A * 5/1972 Snook ..... 178/21
4,284,031 A * 8/1981 Thaxter ..... 118/657
4,321,606 A * 3/1982 Lazzari ..... 346/74.1
4,581,283 A * 4/1986 Tokunaga et al. ..... 428/216
5,037,219 A * 8/1991 Duport ..... 400/241
5,411,798 A 5/1995 Funae et al.

FOREIGN PATENT DOCUMENTS

EP 426 116 A2 5/1991
EP 661 169 A1 7/1995
EP 903 243 A2 3/1999
JP 11-157138 * 9/1997
JP 411091171 A * 9/1997

* cited by examiner

*Primary Examiner*—John S. Hilten
*Assistant Examiner*—Darius N. Cone
(74) *Attorney, Agent, or Firm*—Frishauf, Holtz, Goodman, Langer & Chick, P.C.

(57) ABSTRACT

A tape cassette is set in a cassette accommodating section of a tape printer. A magnetically affixable printing tape is fed out from a holding reel along with an ink ribbon having a non-magnetic ink layer formed thereon across a cut in the tape cassette and conveyed through between a thermal head and a platen roller while being pressed by those elements. The printing tape comprises a printing layer and a magnetic layer pasted to the printing layer. The magnetic layer is magnetized such that S and N poles are alternately arranged longitudinally of the tape to thereby prevent turns of the tape roll from shifting widthwise. The magnetic layer has a coated fluorine layer formed thereon or has wrinkles formed thereon to thereby prevent blocking from occurring on a printing face of the tape due to its winding. Thus, the printing tape is conveyed in a correct attitude to enable a high quality image to be printed thereon.

8 Claims, 13 Drawing Sheets

CASSETTE CONTAINING MAGNETICALLY AFFIXABLE PRINTING TAPE AND TAPE PRINTER WHICH USE THE CASSETTE

BACKGROUND OF THE INVENTION

The present invention relates to cassettes which contain a magnetically affixable printing tape and tape printers which print data on the printing tape.

Conventionally, tape printers are widely used which print a character string on a printing tape and which cut a printed portion from the printing tape to produce a label.

Tape cassettes used in the printers contain a pair of reels around which a printing tape and an ink ribbon are wound, respectively. The printing tape includes a printing layer of a resin film with an adhesive layer coated on its side and a separable paper strip adhered to the printing layer through the adhesive layer. The tape cassette is set on the tape printer and feeds the printing tape and the ink ribbon to a printing section.

The label produced by the tape printer can be pasted on a desired object by separating its separable paper piece therefrom. Once pasted on the object, the label cannot be easily separated from the object because it strongly adheres to the object.

A magnet sheet is known, from which a smaller sheet piece of a desire it size is obtained. Appropriate characters are handwritten on the smaller sheet piece, which is then affixed magnetically, for example, to a white board of steel or another magnetic object for use.

However, the conventional magnet sheet is not composed in consideration of printing in the tape printer and is not suitable for printing. Thus, tape-like magnet materials are desired from which labels are obtained on the tape printer. The inventors have made a series of studies to put to a practical use magnetically affixable printing tapes on which characters/images are printable by the tape printer.

First, in order that the magnetically affixable printing tape may be used in the tape printer like the conventional printing tape with, an adhesive on its side, a magnetically affixable printing tape consisting of a printing layer and a magnetic layer pasted to the printing layer is required to be wound around a reel, and a resulting roll of the printing tape is required to be accommodated within a cassette. Since the printing tape is wound repeatedly around the reel in a superimposing manner, there may occur a trouble, for example, with conveyance of the tape depending on a magnetic pole arrangement pattern formed on the tape, as we have found. For example, a magnet sheet has magnetized lines along which the S and N poles of a particular width alternately arranged extend. A magnetically affixable tape is required to be produced appropriately from the magnet sheet by paying careful attention to the, magnetized lines. Otherwise trouble would occur when a roll of such tape is accommodated within the tape cassette and characters/images are then printed on a tape portion fed out from the cassette.

More specifically, when a magnetic tape is magnetized lengthwise or in a direction of its conveyance, S and N poles are alternately formed so as to be arranged widthwise in the tape and to extend lengthwise of the tape. When such magnetized printing tape is wound repeatedly around a reel in superimposing manner, magnetic poles of the same polarity of adjacent turns of the tape can be superimposed. Thus, a repelling force would occur between those poles and hence their adjacent turns of the tape. Thus, one of those adjacent turns would shift widthwise of the tape relative to the other of the tape turns. Since such repelling force is applied perpendicular to the direction of tape conveyance, the tape is likely to meander when it is conveyed to the printing section to thereby hinder appropriate printing.

When the printing tape is wound around a holding reel, a magnetic layer of one turn of the tape is brought into contact with a back of a printing layer of the adjacent turn. In this case, small particles or grains of the magnetic layer, which contains a mixture of a synthetic resin or synthetic rubber and magnetic powder, would shift to a surface of the printing tape to soil the same, as we found. A printer of this type generally employs a heat-transfer printing system. When inks of the conventional ink ribbon are not supposed as being toed to pint characters on the printing tape, characters/images printed on the tape would be blurred, which is a new problem.

The ink ribbon consists generally of a base film of capacitor paper, glassine or a resin film of polyester or a polyimide resin, and an ink layer coated on the base film. The ink layer includes a mixture of a wax or resin and a coloring agent such as a pigment. When an ink of the ink layer is transferred to the printing medium, a luster occurs on a surface of the ink-transferred to the printing medium, especially in the heat transfer system. In order to suppress this luster, a luster suppressing additive is added into the ink layer or a luster control layer is provided between the base film and the ink layer.

In many cases, a pigment added as a coloring agent to the ink layer is, for example, carbon black or an iron oxide in the case of a black ink. Similarly, the luster control layer contains an iron oxide pigment for delustering.

We also have found in a test for putting the tape to practical use that the "blurs" of the characters printed on the printing tape are due to exertion of the magnetic drawing force of the magnetic layer on the iron oxide pigment contained in the ink layer/luster control layer.

When once a label produced from the magnetic tape is affixed magnetically to a magnetic object, it is difficult to separate the former from, the latter.

When the magnetically affixable printing tape contained in the tape cassette is used substantially up to As end, a small end portion of the tape is likely to remain in, be drawn against, the printer and enter a space in the printer and is difficult to remove.

In color printing by the tape printer the printing tape is reciprocated so as to assume the same printing start position to thereby perform superimposing print in yellow, magenta and cyan inks. In the conventional tape printer, control of quantities of reciprocation of the tape is provided by sensing with an optical sensor a plurality of marks printed at equal intervals lengthwise on the back of the tape and then counting the sensed number of marks.

However, the surface of the magnetic layer generally has a dark color such as brown. In this case, if a plurality of position marks are printed in white at equal intervals such that they can be easily sensed by the optical sensor, they are required to be more or less thick. Thus, irregularities would be produced on the surface of the magnetic layer due to the presence of the marks printed on the surface of the magnetic layer which is brought into contact with the object. Those irregularities would produce gaps between the magnetic layer and the object to thereby reduce the magnetic drawing force of the magnetic layer.

SUMMARY OF THE INVENTION

It is therefore a first object of the present invention to provide a cassette which contains a magnetically affixable printing tape on which a magnetic pole arrangement pattern is formed to enable the tape printer to approximately print characters/images on the tape without causing trouble, for example, with the tape conveyance.

Another object of the present invention is to provide a cassette which contains a magnetically affixable tape in which no parts of the magnetic layer shift to a surface of the printing layer even when the printing layer is wound repeatedly along with the tape around a reel.

Still another object of the present invention is to provide a cassette which contains in combination an ink ribbon and a magnetically affixable printing tape by which no blurs occur when characters/images are printed on the tape in a heat transfer system.

A further object of the present invention is to provide a cassette which contains a magnetically affixable printing tape including a magnetic layer which provides a label which, even if it is once magnetically affixed to the object, can be easily separated from its object.

A still further object of the present invention is to provide a cassette which contains a magnetically affixable printing tape which even when it is used substantially up to its end, no small end portion, of the tape remains within the tape printer and hence no troubles occur.

A still further object of the present invention is to provide a tape printer which even when no marks for controlling a quantity of conveyance of a magnetically affixable printing tape are provided on the tape, is capable of controlling the quantity of conveyance of the tape for reciprocating purposes in color printing.

In order to achieve the; above objects, the present invention provides a cassette comprising a holding reel around which a magnetically affixable printing tape is wound, the cassette being settable in a tape printer which includes conveying means for conveying the tape of the cassette and printing means for printing characters/images on the tape, the tape comprising a printing layer on which characters/images are printed by the tape printer and a magnetic layer containing magnetic powder magnetized widthwise of the tape and pasted at a side to the printing layer.

In a lengthwise magnetized magnetic layer, N and S poles which extend lengthwise the magnetic layer. Thus, when the magnetic tape is wound repeatedly around the reel, a magnetic pole of a polarity of one turn of the tape layer can be superimposed on another pole of the same type of an adjacent turn of the tape layer such that a repelling force occurs between those adjacent poles and those tape turns move widthwise relative to each other. According to the inventive tape, no such repelling force occurs and the tape is appropriately conveyed to the printing section to thereby provide appropriate printing.

In the cassette, a side of the magnetic layer pasted to the printing layer preferably has a coated fluororesin layer for preventing small particles or grains of the magnetic layer from moving to the printing layer when the magnetic layer comes into contact with the printing layer due to the magnetic layer and the printing layer being wound around the holding reel.

The side of the magnetic layer pasted to the pining layer may comprise a wrinkled one.

The ink of the printing ink ribbon accommodated along with the magnetically affixable in the cassette preferably contains a non-magnetic substance ink. By heat-transfer printing characters or images on the tape, using the ink ribbon, no ink transferred to the tape is magnetically drawn, and hence no printed characters/figures are blurred.

The magnetic layer has a non-magnetic area formed along at least one edge of the tape. Since a label produced from such magnetically affixable printing tape has the non-magnetized area a, it can be separated at one of those areas even when it is affixed magnetically to a ferromagnet such as steel.

The cassette preferably comprises an auxiliary non-magnetic tape provided at a trailing end of the magnetically affixable printing tape and bonded to the holding reel to such a degree that the auxiliary tape is separated, or is not separated, from the holding reel of the tape printer by a conveying force exerted by e convey means as the case maybe. By doing so, even when the tape is substantially used up, leaving its small end portion, which remains within the tape printer, it can be easily taken out because the auxiliary tape is attached to the printing tape end.

The present invention also provides a tape printer comprising:

a magnetically affixable printing tape comprising a printing layer on which characters/images are to be printed, and a magnetic layer of magnetic powder pasted to the printing layer and magnetized such that N and S poles are alternately arranged longitudinally of the magnetic layer;

conveying means for reciprocating the tape a plurality of times along a conveyance path in one and the other directions;

printing means for printing characters/images on the tape in a plurality of color inks sequentially in superimposing relationship when the tape is conveyed in the one direction by said conveying means;

detecting means for detecting changes of magnetic poles of the tape which passes a predetermined position along the conveyance path when the tape is reciprocated in the conveyance path by said conveying means; and conveyance control means for counting the number of changes of magnetic poles of the tape detected by the detecting means to control a quantity of conveyance of the tape by said conveying means such that a quantity of conveyance of the printing tape in the one direction becomes equal to a quantity of conveyance of the tape in the other direction.

According to this tape printer, the changes of magnetic poles of the magnetically affixable tape which passes the predetermined position along the conveyance path is detected by the detecting means in the tape conveyance and the quantity of reciprocation of the tape is controlled based on the number of detected changes of the magnetic poles. Thus, even if there are no conveyance quantity control marks formed on the tape, the quantity of reciprocation of the tape is controlled appropriately.

DETAILED DESCRIPTION OF THE INVENTION

An embodiment of the present invention will be described next with reference to the accompanying drawings.

Figure 1:
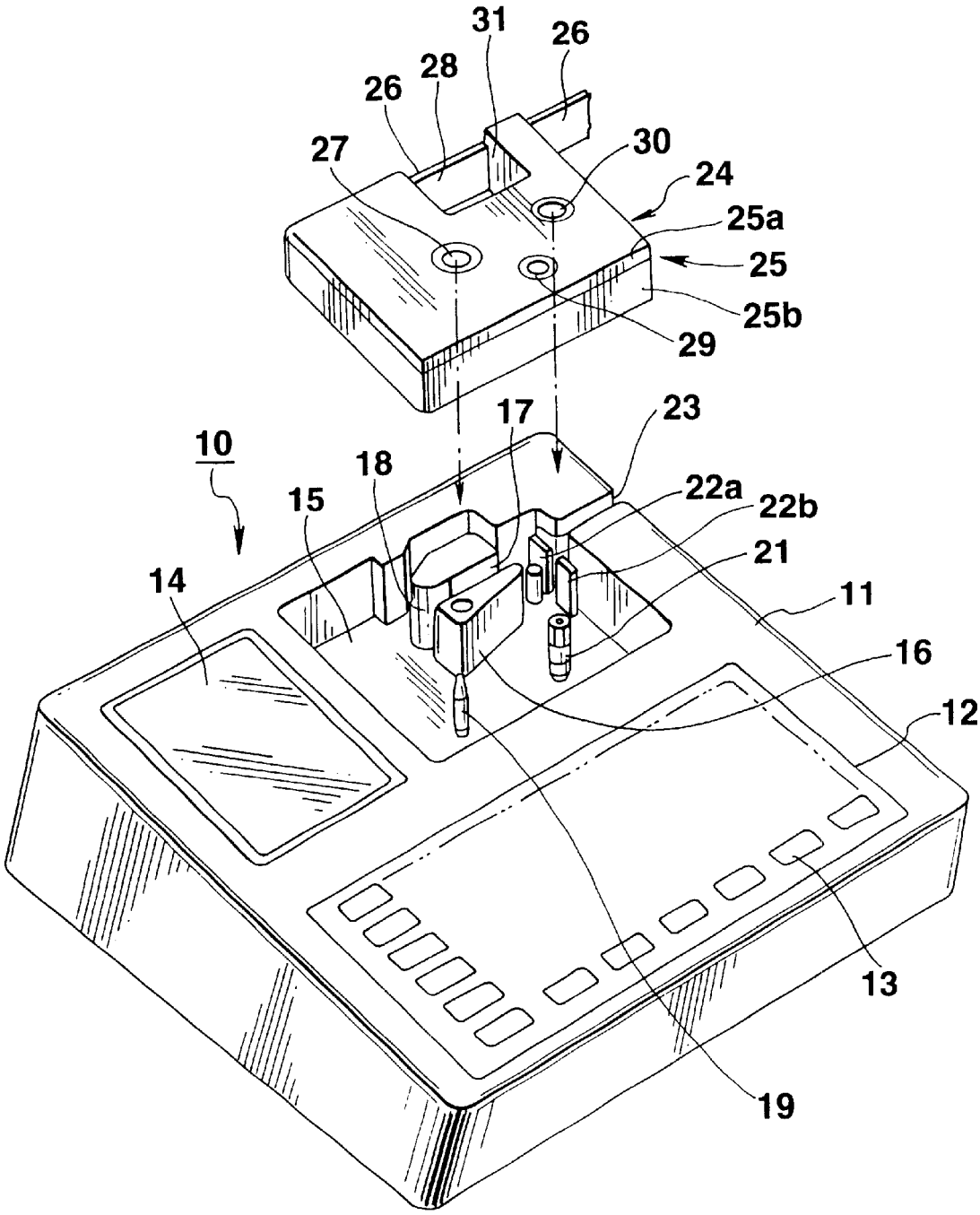
FIG. 1 is a perspective view of a tape printer with a cassette which contains a magnetically affixable printing tape as one embodiment of the present invention being shown separated from the printer.

Referring to FIG. 1, a cassette 24 which contains a magnetically affixable printing tape according to the present invention is shown taken out above a tape printer 10. As shown in FIG. 1, the tape printer 10 has a key-in unit 12 which includes a plurality of keys 13 to be depressed; that is, character input keys, cursor keys, a form setting key, a print key, a cancel key, function keys, a font magnification key, an enter key 13, etc., within one half of its housing 11.

A liquid crystal display unit 14 and a tape cassette accommodating section 15 are provided within the other half of the housing 11. A cover for the tape cassette accommodating section 15 is removed away such that its inside can be seen well. The tape cassette accommodating section 15 contains a swingable thermal head 16 on which a line of heaters (not shown) is arranged; and a platen roller 17 disposed opposite to the thermal head 16.

A guide plate 18, a tape winding shaft 19, an ink ribbon winding shaft 21, and a tape cutter 22 (22*a*, 22*b*) are disposed so as to surround the thermal head 16. A tape discharge exit 23 is formed to the right of the tape cutter 22.

The tape cassette 24 has a cassette case 25 composed of an upper case portion 25*a* and a lower case portion 25*b*. The cassette case 25, contains a holding reel 27 around which a magnetically affixable printing tape 26 is wound repeatedly, a ribbon holding reel 29 around which an ink ribbon 28 of a non-magnetic ink layer is wound repeatedly, and a ribbon winding reel 30 which rewinds a used potion, of the ink ribbon 28.

The tape cassette 24, tape holding reel 27, ribbon holding reel 29. and ribbon winding reel 30 are made of a non-magnetic material such as a synthetic resin.

The cassette case 25 has a cut 31 which receives the thermal head 16 to which the printing tape 26 and the ink ribbon 28 are fed from the cassette case 25.

Figure 2:
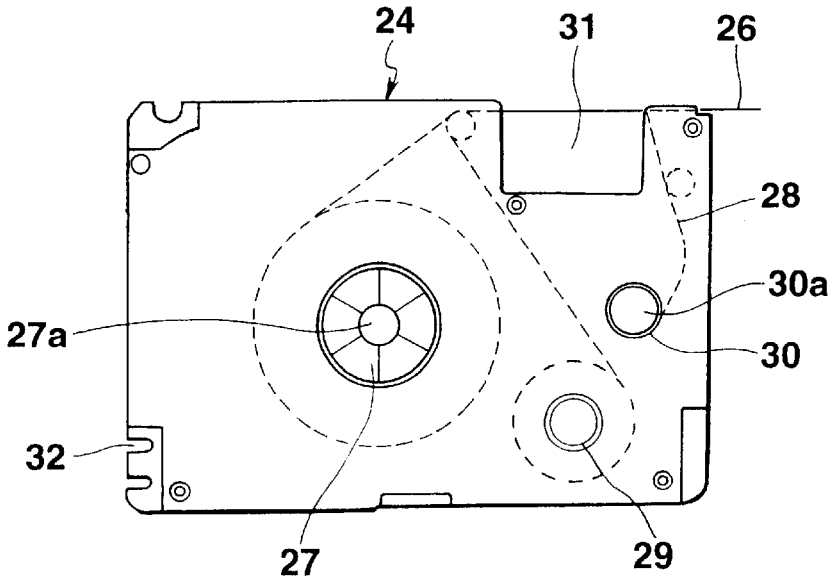
FIG. 2 is a plan view of the cassette.

As shown in FIG. 2, the cassette case 25 has a groove 32 for identifying the kind of the cassette. The tape cassette accommodating section 15 has a microswitch (not shown) to get information on the kind of the cassette represented by the groove 32.

Figure 3:
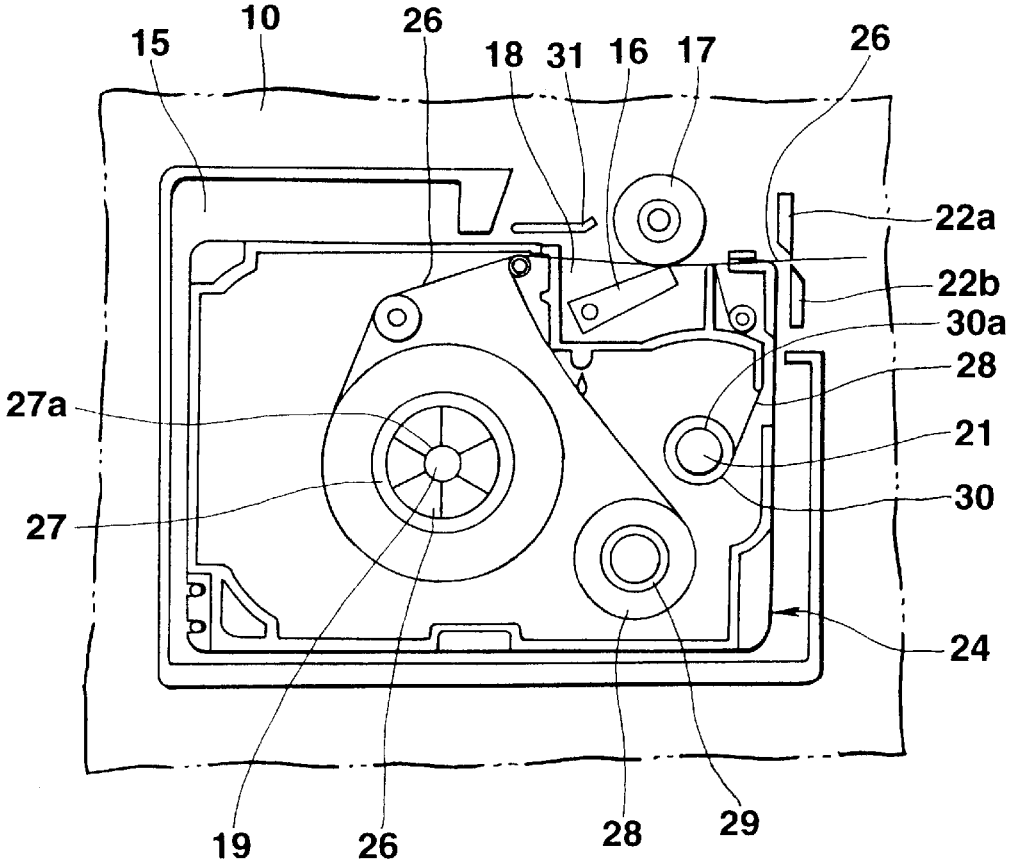
FIG. 3 illustrates the tape cassette set in the tape printer.

FIG. 3 illustrates the tape cassette 24, which contains the printing tape 26, set within the tape cassette accommodating section 15. In FIG. 3, the upper case portion 25*a* is removed away such that the inside of the lower case Portion 25*b* can be seen well.

As shown in FIG. 3, when the tape cassette 24 is set in the tape cassette accommodating section 15, the tape winding shaft 19 is inserted into a hole 27*a* in the holding reel 27 around which the magnetic tape 26 is wound, and the ink ribbon winding shaft 21 is inserted into a hole 30*a* in the ribbon winding reel 30.

As described above, the thermal head 16 is disposed within the cut 31 in the tape cassette 24. The platen roller 17 is disposed opposite to the thermal head 16 outside the cut 31. Thus, the tape 26 and ink ribbon 28 are fed in superimposed relationship to between the thermal head 16, and platen roller 17.

No magnetic metal powder is mixed with the ink and binder in the ink ribbon 28. Also, in order to prevent a luster from occurring on the ink transferred to the tape, the ink ribbon used in the past generally uses an iron oxide (magnetic substance) pigment. In order to avoid blurs in the print in the present embodiment, a mixture of a non-magnetic coloring agent, an ink and a binder is used without using a magnetic pigment such as iron oxygen. Even when a luster appears more or less on the transferred ink on a magnetically affixable printing tape in the embodiment in the use of the tape, for example, magnetic affixation of the printed label to a white, board of steel, there are no visual problems. It is experienced in a test that the addition of a non-magnetic coloring agent to the ink and binder provides a dear printed image compared to a delustered print. Of course, if necessary, dyes or non-magnetic additives may be added to the ink and binder for delustering purposes, instead of the iron oxide pigment.

The ink ribbons contained in the tape cassettes 24 include ones having a base material coated with a black ink for monochromatic printing and a base material coated with yellow, magenta and cyan color inks for color printing.

Figure 4:
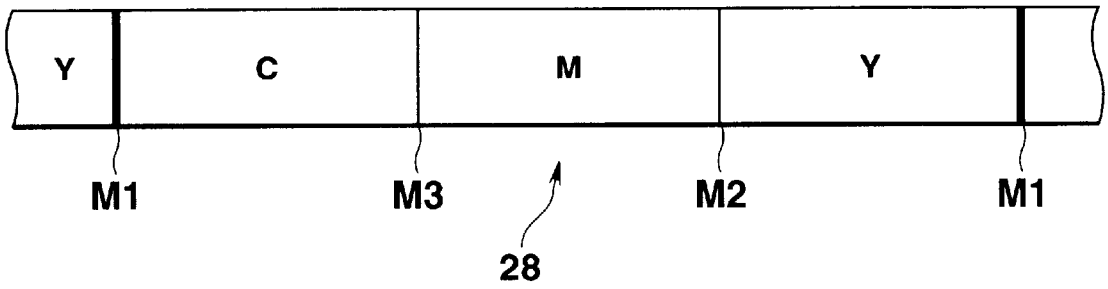
FIG. 4 illustrates the composition of a color ink ribbon contained in the cassette.

FIG. 4 shows a color pining ink ribbon 28 which has a width corresponding to that of the printing tape 26 and head indicating marks M1–M3 each disposed between the yellow (Y), magenta and cyan (C) inks for indicating the respective heads of the inks. The marks M1–M3 differ in width such that each of them represents two adjacent colors bordering that mark.

Figure 5:
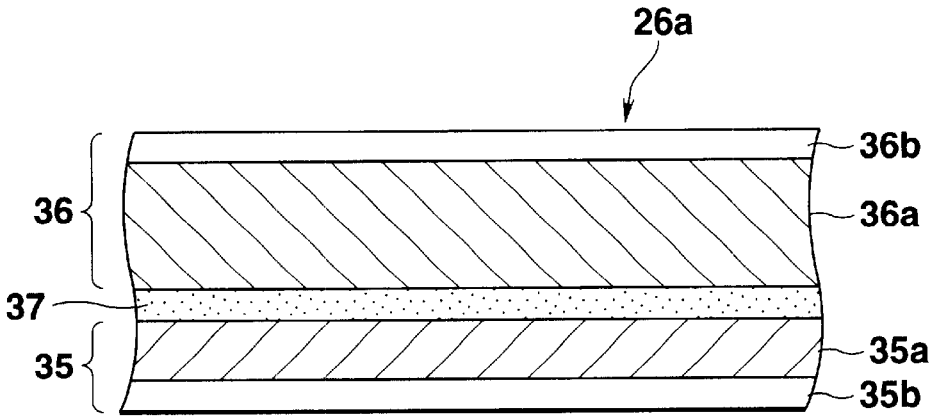
FIG. 5 is an enlarged cross-sectional view of the magnetically affixable printing tape contained in the tape cassette.
Figure 6:
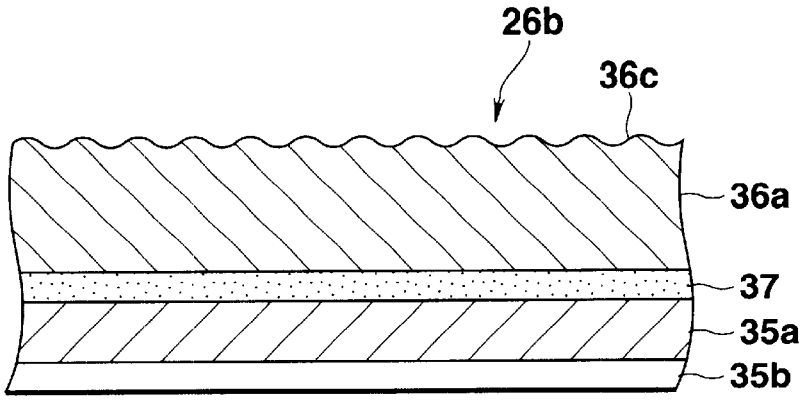
FIG. 6 is an enlarged cross-sectional view of another magnetically affixable printing tape contained in the cassette.

FIGS. 5 and 6 are enlarged cross-sectional views of different magnetically affixable printing tapes 26*a* and 26*b* each contained in the tape cassette 24. The printing tape 26*a* of FIG. 5 includes a printing layer 35 and a magnetic layer 36 pasted through an adhesive layer 37 to the printing layer 35. The printing tape 26*a* of FIG. 5 and the ink ribbon 28 are fed to the printing section of the tape printer 10 such that the printing layer 15 is superimposed on the ink ribbon 28 to thermally print characters/images on the printing layer 35. The printing layer 35 has a polyester layer 35*b* coated on a film, for example, of a PET resin about 40 $\mu$m thick to improve its printability (ink receptivity).

The magnetic layer 36 is made of a sheet-like magnetic substance layer 36*a* 100–300 μm thick and a fluorine layer 36*b* coated on the layer 36*a*. The materials of the magnetic layer 36 include a mixture of a resin such as a polyethylene chloride or a rubbed macromolecule such as natural rubber, neoprene, isopreme, NBR (nitro butadiene rubber) or SBR (styrene butadiene rubber) and ferromagnetic powder, for example, of magnetite, ferrite or a cobalt oxide.

The layers 35 and 36 are bonded through an acrylic adhesive layer 37 such that the respective surface layers 35*b* and 36*b* face outward. The half-finished product is then magnetized in a strong magnetic field to complete the magnetically affixable printing tape 26*a*.

Alternatively, the magnetic layer 36 itself may be cut away from a magnetic substance sheet and then pasted through an acrylic adhesive layer 37 to a back of the resin film 35*a*. For example, resin magnetic tapes include composite resin magnet materials which contain as a binding agent a thermoplastic resin such as nylon polypropylene, polyethylene, polyethylene, chloride or vinyl acetate. One of those materials is thermally pressed with a press roller to make uniform thy magnetizing directions of grains of ferromagnetic powder contained in the material perpendicular to a surface of the sheet to thereby form a magnetic tape. The ferromagnetic powder includes Ba or Sr ferrite powder, Alnico magnet (Se-Cr-Co). powder, rare earth cobalt magnet powder and rare earth iron magnet powder, as well known.

More specifically, for example, a mixture of a polyamide resin having a melting viscosity of 30–50 Poise at 200° C. and 80–90 weight % of barium ferrite powder and 0.1–1 weight % of zinc stearate or polyethylene wax is kneaded at a temperature of 150–180° C., and then pressed so as to have a thickness of 0.1–0.5 mm. The resulting half-finished product is immediately put in an orienting magnetic field of 10,000 Oersted by a magnetizer, and then cooled to provide a magnet sheet, which has, 700–1600 G(Gauss) as a surface magnetic Ax density, which is usable as the printing tape in the present invention.

The magnetically affixable printing tape 26*b* of FIG. 6 is the same in composition as the tape 26*a* of FIG. 5 in that they include PET resin film 35*a*, its surface layer 35*b*, acrylic adhesive layer 37, and magnetic substance layer 36*a*, excluding a wrinkled surface layer 36*c* formed on the magnetic substance layer 36*a* instead of a coated fluorine layer.

Figure 7:
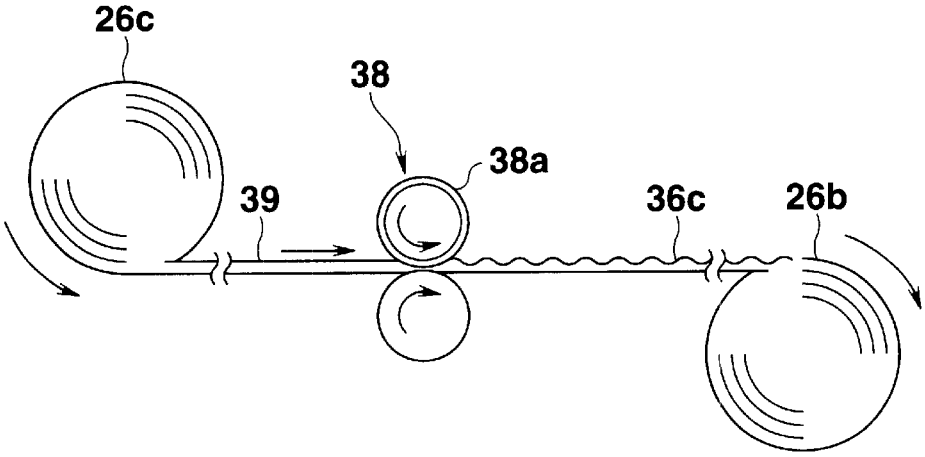
FIG. 7 schematically illustrates forming wrinkles with rolls on the magnetic tape.

As shown in FIG. 7, the preproduced tape 26*c* composed of PET resin film 35*a*, its surface layer 35*b*, acrylic adhesive layer 37, and magnetic substance layer 36*a* is passed through a pair of press rollers 38, one of which (in this example, 38*a*) has a wrinkled surface, and pressed such that a smooth surface 39 of the tape 26*c* is changed to a wrinkled surface 36*c*. The tape 26*b*, thus obtained, is wound around a holding reel 27 and accommodated in a cassette case 25, as shown in FIG. 3.

Alternatively, without pressing the preproduced tape 26*c* with the pair of rollers, the tape may be wrinkled in the finishing step subsequent to the pasting step or a magnetic substance sheet (magnetic substance layer 36*a*) only may be previously wrinkled and then pasted to other layers, as shown in FIG. 6.

The wrinkling is not only performed by the above pressing step. For example, a surface of the magnetic substance layer 36*a* may be processed with appropriate chemicals so as to form a coarse surface.

The reason why the surface of the magnetic substance layer 36*a* is coated with fluorine or wrinkled, as shown in FIG. 5 or 6, is to prevent "blocking" which would otherwise occur after the magnetic substance layer 36*a*, thus obtained, is wound around the holding reel 27 and then put in the tape cassette 24, as shown in FIG. 3, as clarified experimentally.

The "blocking" implies that as the printing tape 26 is wound around the holding reel 27, grains of magnetic powder contained in a dispersive manner in the magnetic. substance layer 36*a* are combined with, and shift to, a printing surface (of an improved ink-receptivity surface layer 35*b*) which is wound sequentially along with the magnetic layer 36*a* to be brought into contact with the magnetic substance layer 36*a*. Once such blocking occurs, the printing tape surface would be soiled, an appropriate print image could not be formed, and its image quality would be deteriorated.

According to the present invention, by coating a surface of the magnetic substance layer 36*a* with fluorine to confine, the magnetic powder, to within the magnetic layer 36*a*, as described above, the occurrence of the blocking is prevented with high reliability.

Only by forming wrinkles on the surface of the magnetic layer 36*a* instead of coating the same with fluorine, blocking is prevented from occurring, as we formed. It has also been found that irregularities of a surface of the magnetic layer 36*a* due to the wrinkling step are preferably coarser than those of the surface of the improved ink-receptivity surface layer 35*b* as the printing surface to prevent the occurrence of the blocking.

When the printing tape is produced, first a magnet sheet (magnetic substance sheet) is produced or a commercially available magnet sheet is gotten and worked so as to provide a tape. The magnet sheet has magnetized lines along which magnetic poles S and N arranged alternately extend.

Unless a tape is produced from the magnet sheet by paying appropriate attention to the magnetized lines, the following trouble would occur substantially when a part of the finished magnetically affixable printing tape 26 is wound around the holding reel 27 and then accommodated within the tape cassette 24.

Figure 8:
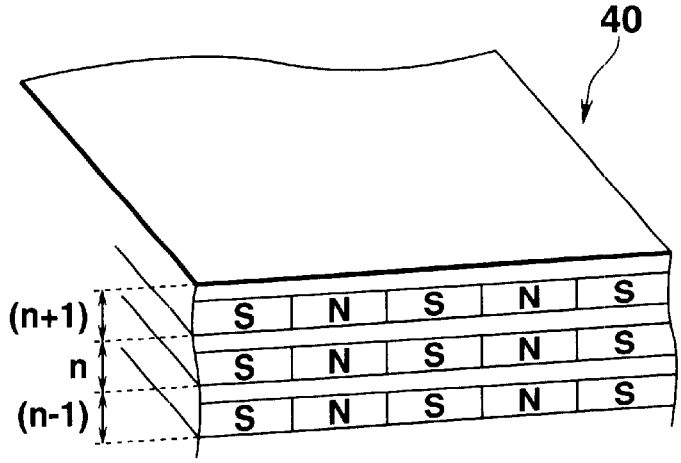
FIG. 8 intelligibly illustrates in cross section only three of turns of a magnetically affixable printing tape wound around a reel.
Figure 9:
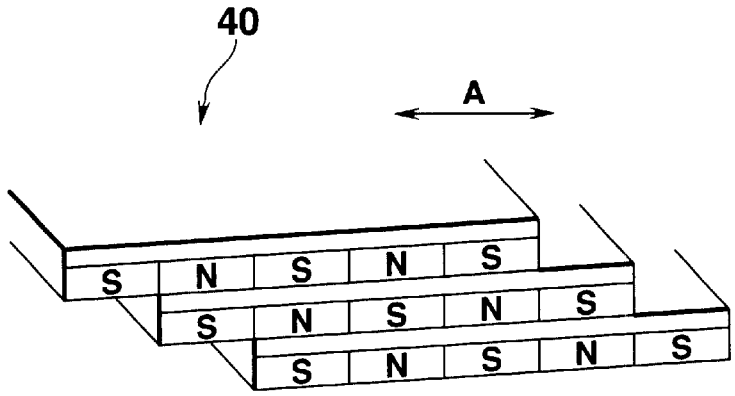
FIG. 9 illustrates a principle of occurrence of a trouble in the case of FIG. 8.
Figure 10:
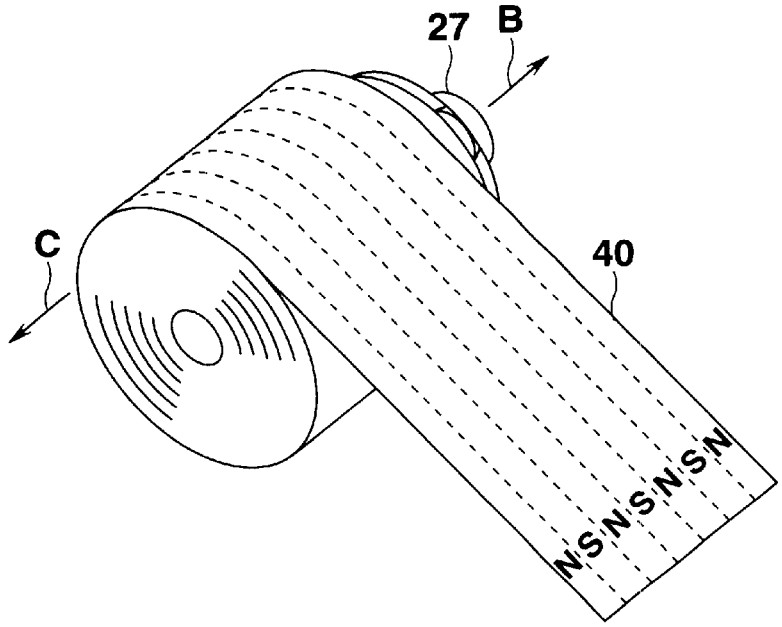
FIG. 10 illustrates axial shifts of all the respective turns of a tape roll of FIG. 9.

FIG. 8 illustrates in cross section only three taken-out (n–1)th, nth and (n+1)th turns of an experimentally produced magnetically affixable printing tape 40 which is wound: around the holding reel 27. FIGS. 9 and 10 show a trouble which may occur in this case. As shown in FIG. 10, in this example, the whole tape is magnetized such that the directions of the magnetizing lines on the magnet sheet coincide with the longitudinal line of the printing tape 40.

When the tape 40 is wound around the holding reel 27, as shown in FIG. 8, the same poles, for example, S or N poles, of the respective turns of the tape are, arranged in overlapping manner. Thus, those poles repel with each other and the respective tape turns shift widthwise as shown in FIG. 9, or widthwise from the reel 27, as shown by arrows B and C in FIG. 10. Thus, the tape is difficult to handle and the tape is not fed appropriately to the thermal head 16.

Figure 11:
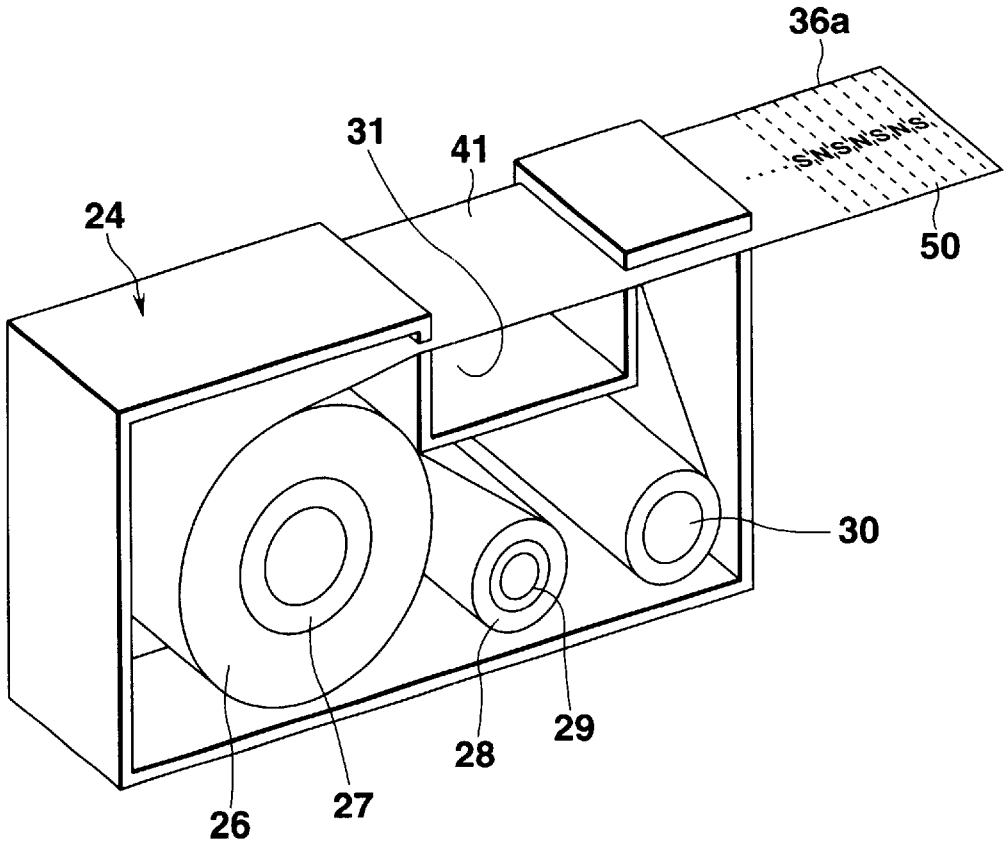
FIG. 11 is a perspective view of the cassette.
Figure 12:
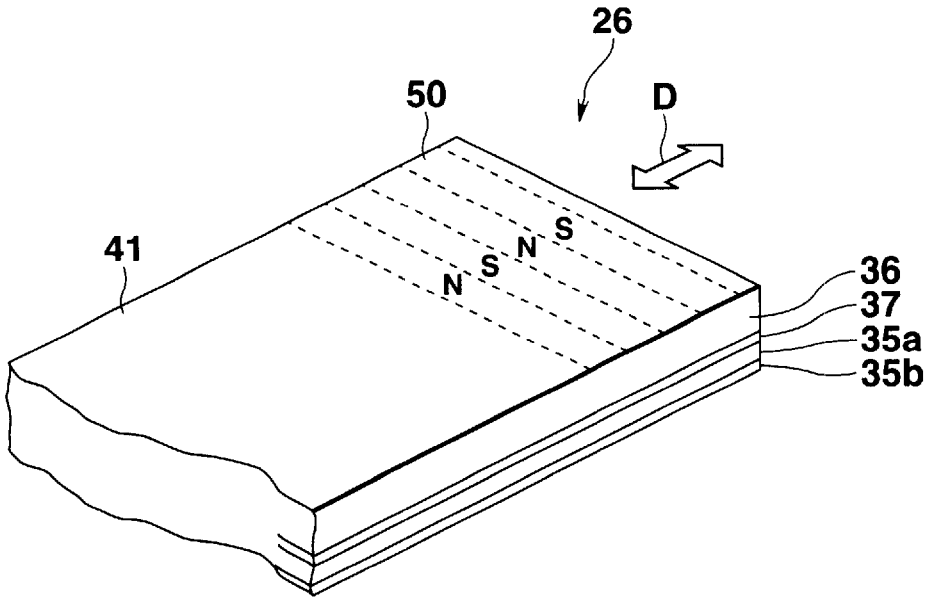
FIG. 12 illustrates the compositions of a magnetically affixable printing tape and especially its magnetic layer according to the present invention accommodated in the cassette of FIG. 11.

However, this trouble is solved by the present invention which will be described next. FIG. 11 is a perspective view of the tape cassette with its upper case so portion being removed away to illustrate the magnetically affixable printing tape accommodated within the tape cassette. FIG. 12 illustrates the composition of the magnetic layer (magnetic substance layer) of the magnetically affixable printing tape to be accommodated within the tape cassette of FIG. 11.

Since the tape of FIG. 12 is the same in composition as that of FIG. 5, excluding the magnetic substance layer, the corresponding elements of FIGS. 12 and 5 are identified by the same reference numeral. Similarly, since the tape cassette of FIG. 11 is the same in composition as that of FIG. the corresponding elements of FIGS. 11 and 3 are identified by the same reference numeral.

As shown in FIG. 11, the tape 26 is magnetized widthwise such that N and S poles are alternately formed lengthwise of the tape on the magnetized surface 41 of the magnetic substance layer 36*a*, each pole having a length equal to the tape width and a width of 2 mm. In this case, the magnetizing lines 50 coincide with the direction of the tape width. Thus, when the tape 26 is wound so as to take the form if a pancake, the diameters of turn of the respective wound layers sequentially increase. Thus, the poles of the same polarity of the adjacent turns of the tape seldom overlap, as shown in FIG. 8. If any, the repelling force is produced longitudinally of the tape or radially of the turns of the, tape and not widthwise of the tape as shown in FIG. 9.

Thus, when the tape 26 which is wound around the holding reel 27 and accommodated within the tape cassette 24 is fed out along with the ink ribbon 28 from the tape cassette 24 as shown in FIG. 11 to the printer section, and characters/images are printed on the tape with the aid of the ink ribbon 28, the respective turns of the tape in the form of a pancake will not shift axially to thereby take the form of, for example, a cone as shown in, FIG.10,.

Figure 13:
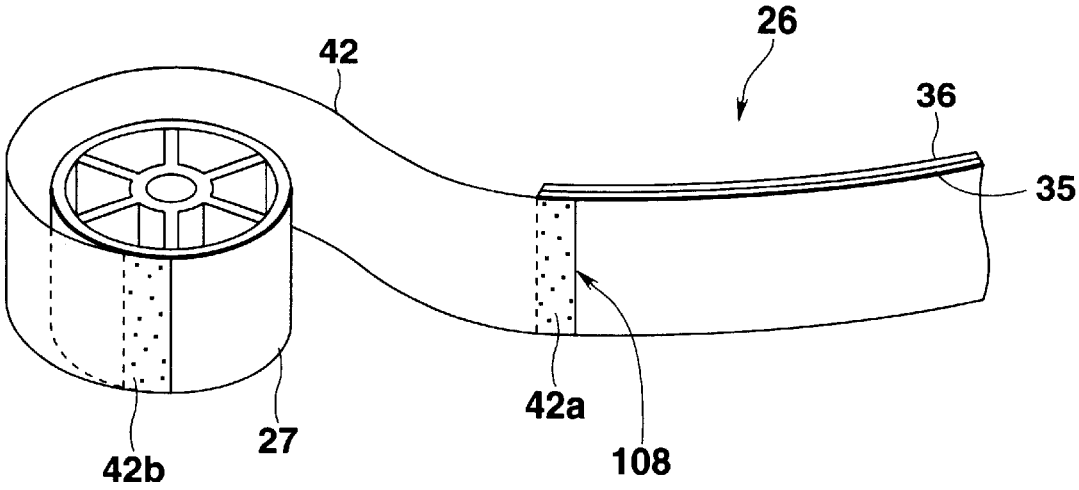
FIG. 13 illustrates connection of the magnetically affixable printing tape to the reel through an auxiliary tape.

As shown in FIG. 13, the tape 26 is fixed at an end to one end 42*a* of an auxiliary tape 42 with an adhesive. The auxiliary tape 42 is temporarily fixed at the other end to the holding reel 27 with a weak adhesive agent or tape to such a degree that when the tape 26 is driven by the platen roller 17 in a pressed state between the platen roller 17 and the thermal head 16, the tape 26 is separated from the auxiliary tape 42. The auxiliary tape 42 is made of a non-magnetic synthetic resin. Preferably, the length of the auxiliary tape 41 exceeds at least the distance between the thermal head 16 and the cutter 22 or at least the distance between the thermal head 16 and the tape discharge exit 23 such that even when the tape 26 is used substantially up to its end with an end portion of the tape 26 remaining within the printer due to the cutting operation, the tape end portion is easy to take, out from the tape printer because the tape end potion is fixed to the auxiliary tape 42.

Alternatively, the auxiliary tape 42 may be bonded at its other end 42*b* strongly to the tape holding reel 27 to such a degree that the auxiliary tape 42 is not separated from the reel 27 by the tape conveying force applied by the platen roller 17 thereto. In that case, the length of the auxiliary tape 42 preferably exceeds at least the distance between the holding reel 27 and the cutter 22 or at least the distance between the reel 27 and the tape discharge exit 23 in a state where the tape cassette 24 is set within the tape cassette accommodating section 15.

By doing so, finally, since the end portion of the tape 26 can be taken necessarily out of the tape printer in a state is pasted to the auxiliary tape 42, it does not enter the printing mechanism.

Alternatively, only a printing-layer 35 may be provided at the end of the magnetically affixable printing tape 26, and pasted to the tape holding reel 27 without providing the auxiliary tape 42 and the magnetic layer 36.

Figure 14:
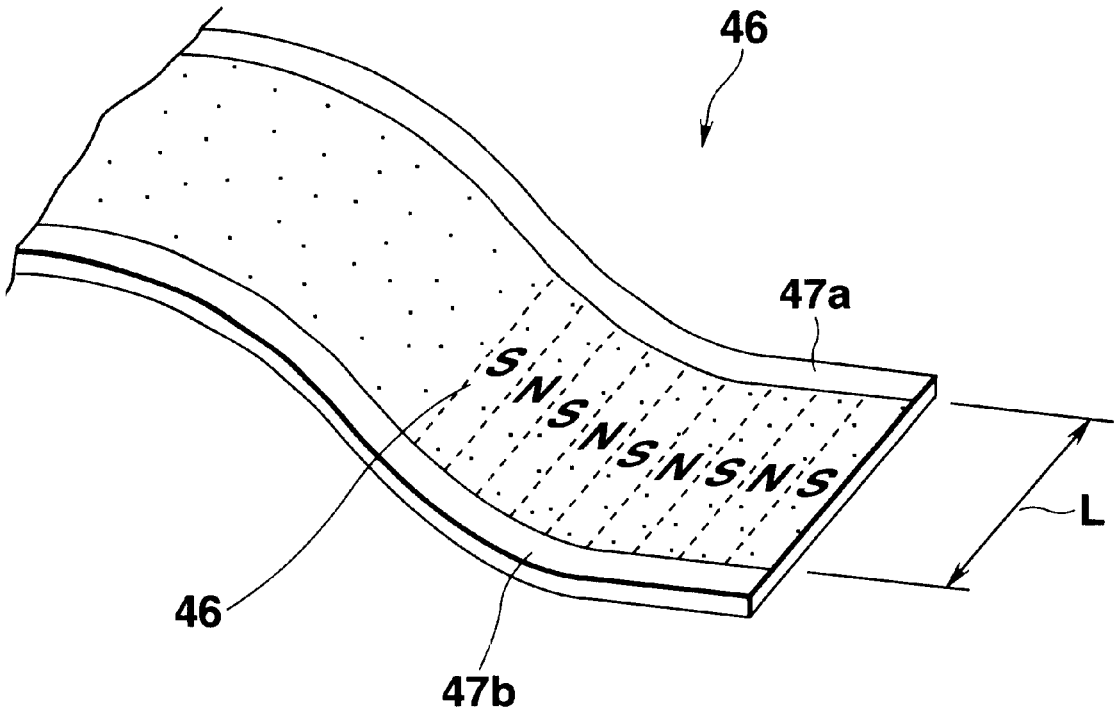
FIG. 14 illustrates another magnetically affixable printing tape according to the present invention.

FIG. 14 shows a part of a back (magnetized surface) of a magnetically affixable printing tape of another example. In FIG. 14, reference numeral 46 denotes a magnetized area where magnetic poles S and N of a width L are formed alternately longitudinally of the tape, as shown in FIG. 12. Reference numerals 47*a* and 47*b* each denote a non-magnetized edge.

Only the magnetized area of a width L can be formed by a strong magnetic field or by forming a magnetic substance containing polymer material on a portion of the base film having the width L. The non-magnetized area may be provided at one of the side edges 47*a* and 47*b*. In either of both the cases, when a magnetically affixable printing tape, for example, affixed magnetically to a white board of steel is to be separated from same, a side edge of the tape is easily picked up by fingers.

Figure 15:
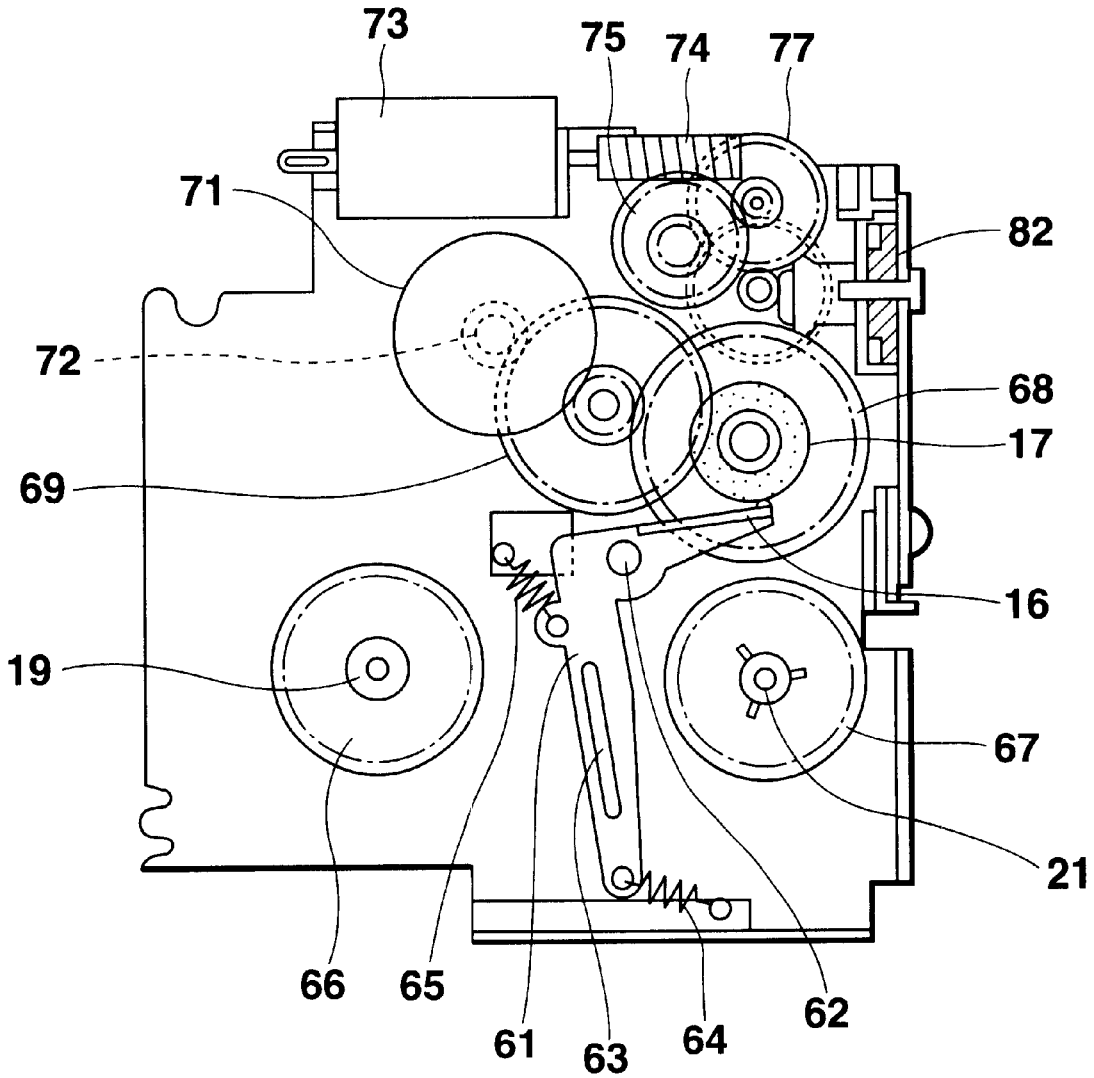
FIG. 15 is a plan view of a driving mechanism for the tape printer.
Figure 16:
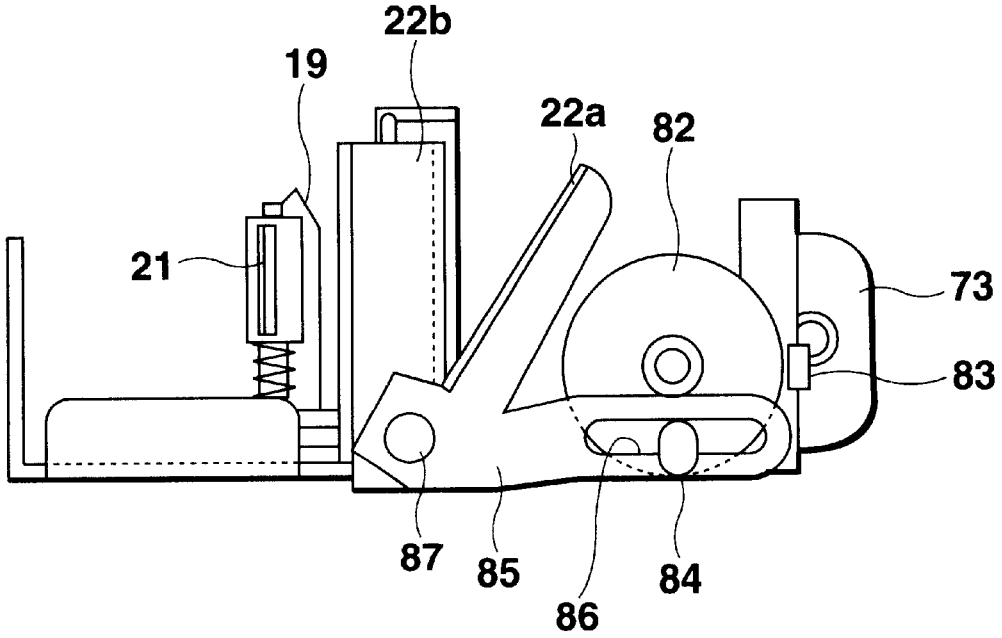
FIG. 16 is a side view of the driving mechanism.
Figure 17:
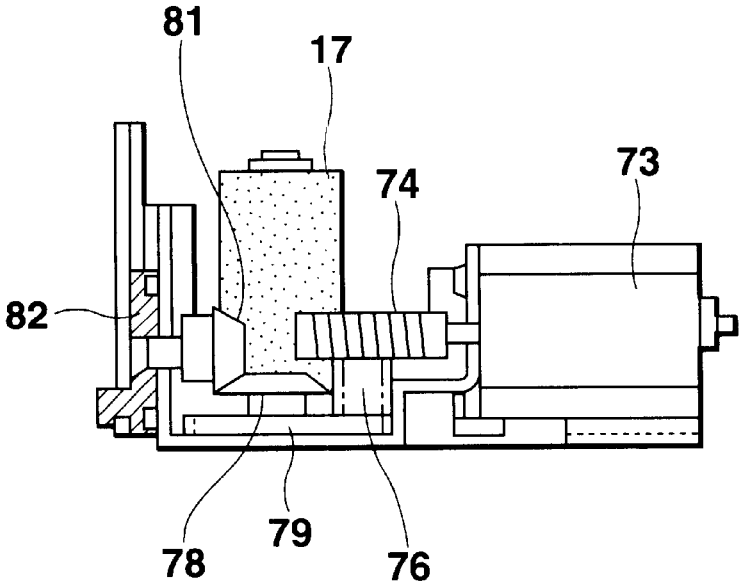
FIG. 17 is another side view of the driving mechanism.

A driving mechanism of the tape printer of FIGS. 1 and 3 will be described next. FIGS. 15–17 show the driving mechanism for the elements of the tape printer of FIG. 1 and 3. FIG. 15 is a plan view of the driving mechanism, and PIGS. 18 and 17 are each a side view of the driving mechanism. The driving mechanism of FIGS. 15–17 is arranged below the bottom, or in the vicinity of, the tape cassette accommodating section 15 in the FIG. 1 housing A FIGS. 15–17 show the thermal head 16, platen roller 17, tape winding shaft 19 and ink ribbon winding shaft 21 of FIG. 1 in order to illustrate the positional relationship between each, of those elements and the driving mechanism.

The thermal head 16 and a head arm, 61 compose an L-like member which is pivoted at a point 62 in the vicinity of its corner. The head arm 61 has an elongated slot 63 in which a cam pin (not shown) is slidablly received. The head arm 61 is biased counterclockwise by a tension spring 64 which extends between a free end of the head arm 61 and a housing frame. A tension spring 65 is provided between the vicinity of the corner of the L-like member and the housing frame so as to bias the head arm 61 clockwise.

As the cam (not shown) is driven so as to leftward move its pin received slidably in the slot 63, the head arm 61 and hence the thermal head 16 are turned clockwise around the pivot 62, and the thermal head 16 is moved to a non-printing position. When the cam is driven so as to rightward move the pin in the slot 63, the thermal head 16 is turned counterclockwise around the pivot 62 such that the thermal head 16 is pressed at its printing unit (a heater array) provided at its free end against the platen roller 17 through the printing tape 26 and ink ribbon 28.

The tape winding shaft 19 is engaged with a gear 66 which is coupled to a drive system (not shown), and rotated only when the tape is returned back to its print starting position in the color printing operation. The ink ribbon winding shaft 21 is engaged with a gear 67 which is coupled to a drive system (not shown), and rotated.

The platen roller 17 includes a platen gear 68 which is engaged with a smaller gear of a speed changing gear unit 69, which has a larger gear meshing with a drive gear 72 of a tape feed motor 71.

A tape cut driving mechanism is provided, which includes a DC motor 73 which has a drive shaft fixed to a worm 74 which meshes with a worm wheel 75. A smaller gear integral with the worm wheel 75 meshes with a spur gear 79 integral with a bevel gear 78, which meshes with another bevel gear 81. Thus, the rotations of the bevel gear 78 driven by the DC motor 73 in a horizontal plane are converted to those of the bevel gear 81 in a vertical plane. A cutter cam 82 is coaxially coupled to the bevel gear 81. A micro switch 83 is provided on a printer frame in contact with the periphery of the cutter cam 82. The micro switch 83 detects the initial position of the cutter cam 82 based on a recess provided at a predetermined position on the periphery of the cutter cam 82 and delivers its detection signal to a controller 90 to be described later.

A pin 84 provided on a periphery of the cam 82 to assume its lowest position when the cutter cam 82 is at its initial position is slidably received in a slot 86 in a turning arm 85 integral with a movable blade edge 22*a* of the tape cutter 22 with a free end of the pin 84 which extends through the slot 86 being bent outside the slot 86 such that the pin is not disengaged from the slot 86. As described above, when the cutter cam 82 is rotated counterclockwise via the worm 74, worm wheel 75, smaller gear 76, reduction gear 77, spur gear 79, and bevel gears 78 and 81, the turning arm 85 of the tape cutter 22 is turned counterclockwise and then, clockwise by the pin 84 in a vertical plane around the pivot 87 to thereby dose/open the movable blade edge 22*a* against/from away the fixed blade edge 22*b* of the tape cutter 22 to cut a tape portion away.

Figure 18:
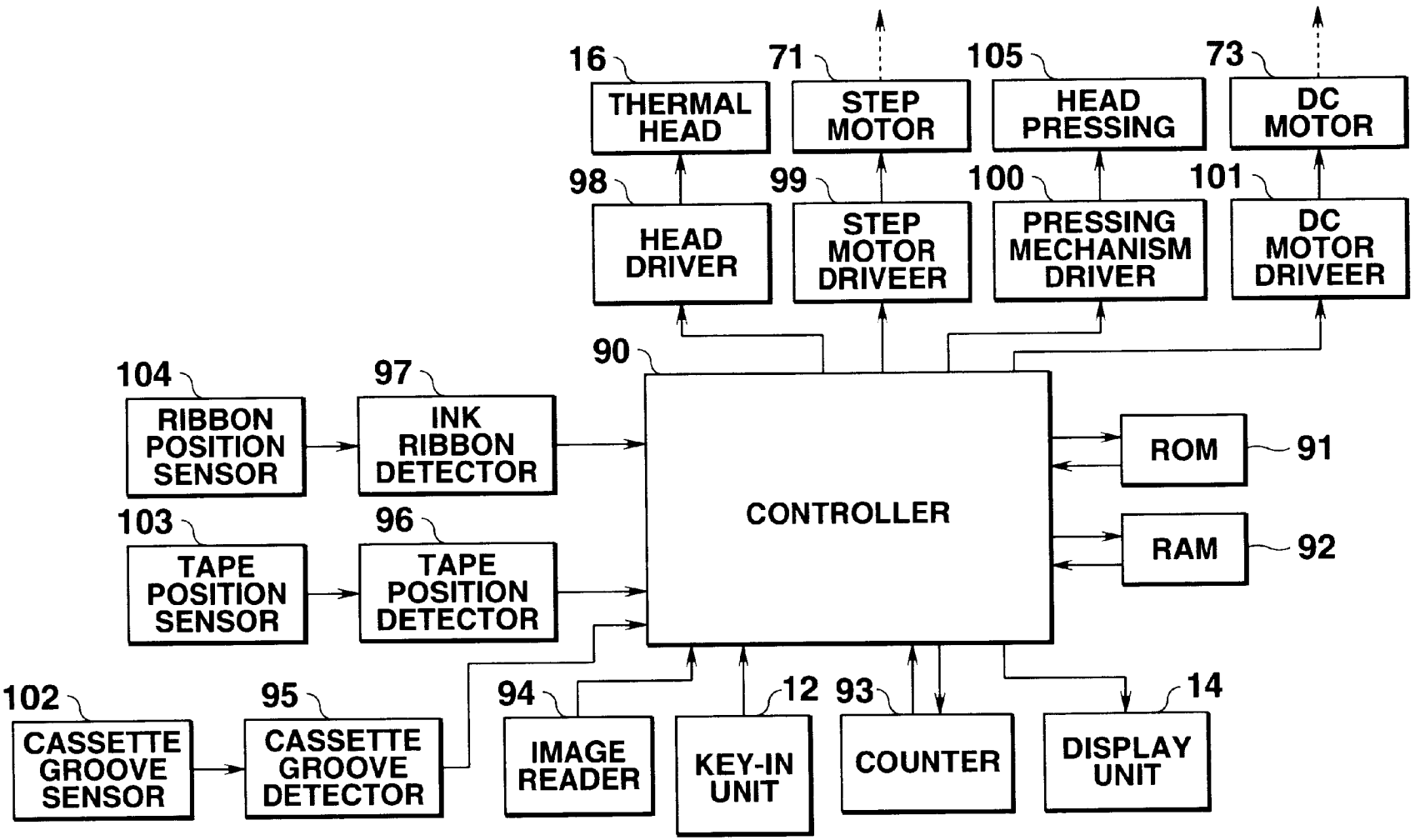
FIG. 18 is a block diagram of an electronic circuit of the tape printer.

Referring to FIG. 18, the controller 90 includes a CPU which is connected to the display unit 14 and the key-in unit 12 shown in FIG. 1. The CPU is connected to a ROM 91, a RAM 92, a counter 93, an image reader 94, a cassette groove detector 95, a tape position sensor 96, an ink ribbon sensor 97, a head driver 98, a step motor driver 99, a pressing mechanism driver 100 and a DC motor driver 101.

ROM 91 contains programs which control the operation of the tape printer 10. The controller 90 controls the, operation of the respective elements of the printer based on a program read from ROM 91.

RAM 92 contains an image data area, a print data area, a flag area, a register area, a counter area, a work area, etc., (not shown), which temporarily store predetermined data under control of the controller 90.

The counter 93 sequentially increments is initial set value to generate serial numbers when characters/image are printed.

The image reader 94 includes a scanner composed of a CCD (charge coupled device). It reads and outputs an image, for example, of a face photograph for label printing. The cassette groove sensor 102 senses a cassette identification groove 32 formed in the tape cassette 24 which contains the printing tape 26, and provides a corresponding sensed signal to the cassette groove detector 95, which receives the sensed signal and delivers it to the controller 90.

Figure 19:
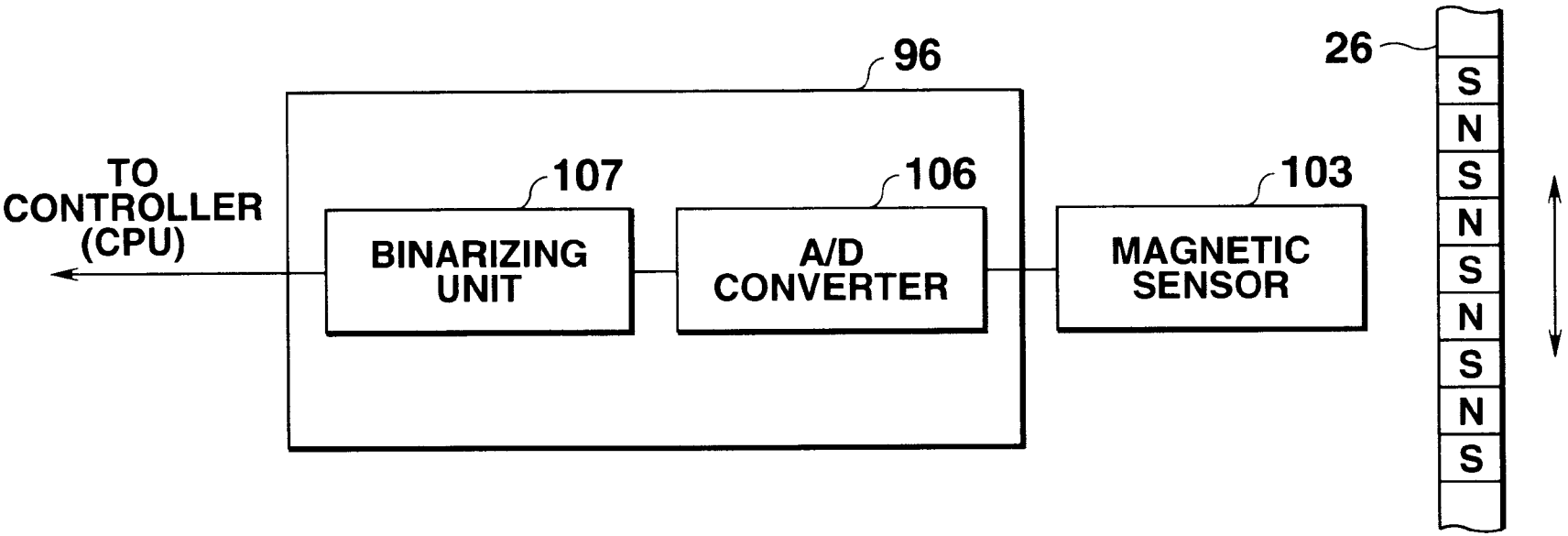
FIG. 19 shows the composition of a tape position detector coupled to a tape position sensor.

Referring to FIG. 19, the tape position detector 96 is connected to a tape position sensor 103 includes a magnetic sensor. The tape position detector 96 includes an AM converter 106 and a binarizing unit 107. The magnetic sensor 103 is composed of a magnetic resistance element and disposed at predetermined position along the tape conveyance path in the tape printer 10.

The N and S poles are alternately formed lengthwise on the tape 26. Thus, when the tape 26 passes by the tape position sensor 103, the strength of the magnetic field applied from the tape 26 to the tape position sensor 103 and hence the resistance value of the magnetic resistance element or tape jot don sensor 103 change. The tape position sensor 103 outputs an analog signal depending on the strength of the magnetic field. This signal is converted by an A/D converter 106 to a digital signal, which is then binarized by the binarizing unit 107 and provided for the controller 90. The magnetic sensor 103 senses magnetic characteristics of the magnetically affixable printing tape 26 changing as the tape 26 is conveyed. The controller 90 detects a position of the tape 26 in the conveying path by counting the number of changes of the polarities of the magnetic poles of the tape.

Returning back to FIG. 18, the ink ribbon detector 97 is connected to the ribbon position sensor 104, which include an optical sensor. This optical sensor senses a print starting position for each of yellow, magenta and cyan of a color ink ribbon in the full color printing, and outputs a corresponding sensed signal. The ink ribbon detector 97 delivers this signal to the controller 90. The ribbon Position sensor 104 senses, for example, marks M1–M3 in the example of FIG. 4.

The head driver 98 is connected to the thermal head to heat same under control of the controller 90.

The motor driver 99 drives the tape feed or step motor 71 to thereby drive the platen roller 17, tape winding shaft 19 and ribbon winding shaft 21 through a gear chain and a clutch mechanism (not shown).

The pressing mechanism driver 100 is connected to a head pressing mechanism 105 comprised of a motor or a solenoid. The pressing mechanism driver 100 drives the head pressing mechanism 105 forwardly or backwardly. In printing, it turns and presses the thermal head 16 to and against the platen roller 17. When the printing tape 26 is fed backwardly to superimpose three prime colors in the full color printing or the printing is terminated, the pressing mechanism driver 100 turns the thermal head 16 away from the platen roller 17.

The DC motor driver 101 drives the DC motor 73 to operate the cutter 22.

Figure 20:
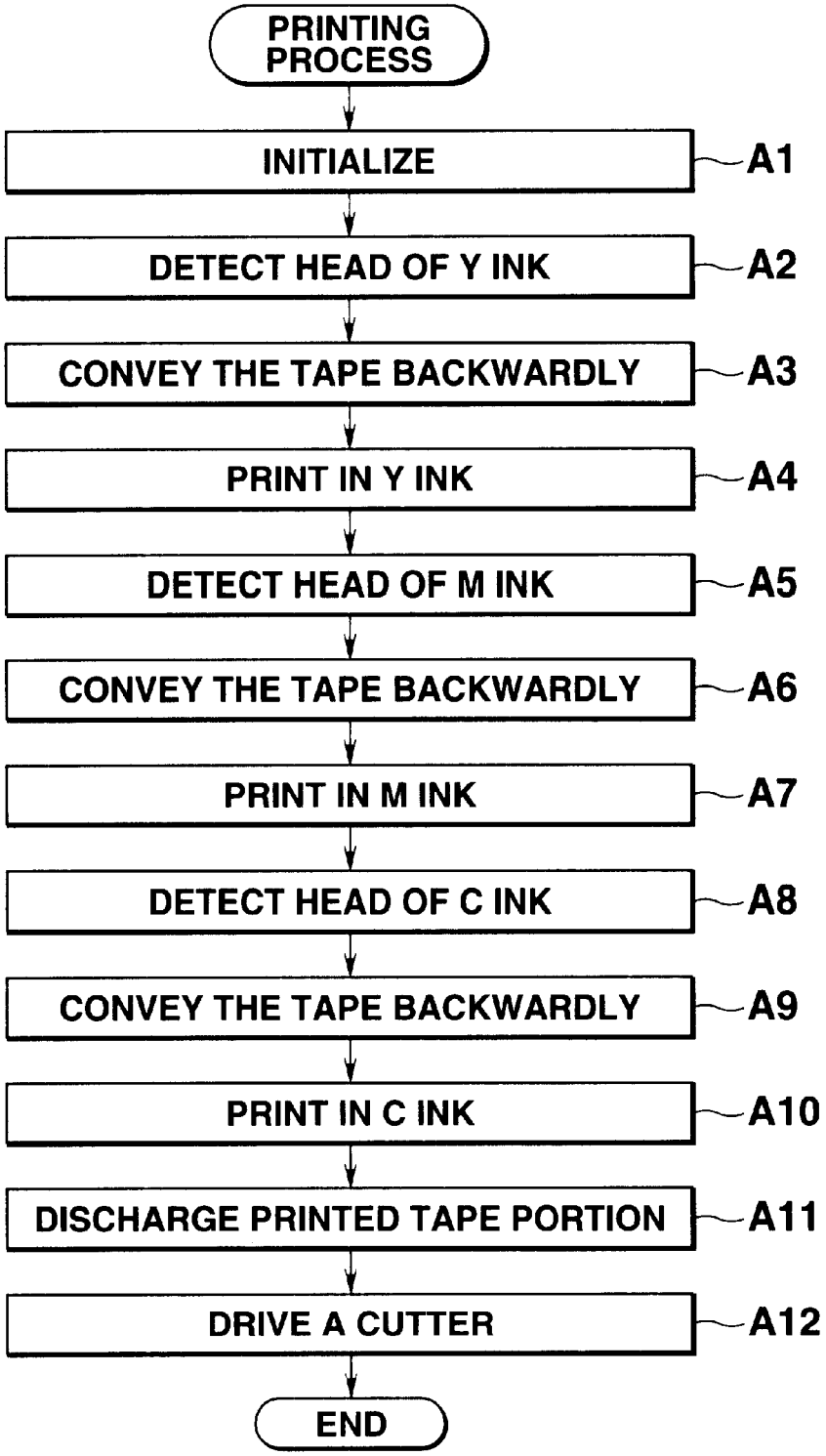
FIG. 20 is a flowchart of a color printing process performed by the tape printer.

Operation of the tape printer 10 in color printing will be described next with respect to FIG. 20 which is a flowchart of a printing process performed by the tape printer. This operation is started by depressing the print key of the key-in unit 12 (step A1).

When the printing section prints data stored in the RAM 92 in colors, first, the head of an yellow ink Y contained in the ink ribbon 28 is detected (step A2). More specifically, the ink ribbon winding shaft 21 and the platen roller 17 are rotated by the step motor 71 to convey the ink ribbon 28 and the printing tape 26 together. The ribbon position sensor 104 senses a head indicating mark M1 of the ink ribbon 28 to thereby terminate this process. In this process, a quantity of conveyance of the magnetically affixable printing tape 26 and the ink ribbon 28 is counted based on the output from the tape position sensor 103. As described above, when the tape 26 passes by the tape position sensor 103 placed at a fixed position, a signal representing its pole changing appears on the output of the tape position sensor. Thus, a conveyance quantity counter (not shown) provided M1 the RAM 92 counts the number of times of pole changing.

After the head of the Y ink is detected, the thermal head 16 is released from the platen roller 17, the tape winding shaft 19 is rotated, and only the tape 26 is conveyed backwardly through a distance (step A3) which corresponds to the conveyance quantity counter in the RAM 92 counting down from its present count to zero based on the output signals from the tape position sensor 103.

The thermal head 16 is then pressed against the platen roller 17 through the ink ribbon 28 and the printing tape 26. In this state, the thermal head driver 98 causes the heaters, of the thermal head 16 to produce heat in accordance with print data stored in the RAM 92 to thereby transfer the Y ink of the ink ribbon 28 thermally to the printing tape 26. The step motor driver 99 then drives the step motor 71 to rotate the platen roller 17 and the ink ribbon winding shaft 21 to thereby convey the ink ribbon 28 and the tape 26 downstream to the next printing position. In this way, the printing of one line by the thermal head 16 and downward conveyance of the ink ribbon 28 and the printing tape 26 are repeated until an image is printed in the Y ink lengthwise on the tape 26. The quantity of conveyance of the tape 26 is counted up based on the output from the tape position sensor 103 in this Y ink printing, and stored in the conveyance quantity counter (step A4). $Subsequently to the termination of the image printing in Y ink color, the tape 26 and the ink ribbon 28 are Other conveyed downstream while the head of the magenta ink is being detected. Also in this case, the quantity of conveyance of the tape 26 is counted up based on the output from the tape position sensor 103, the count, thus obtained, is added to the count produced in the Y ink printing, and the resulting count is then stored in the conveyance quantity counter (step A5).

Then, the thermal head 16 is released from the platen roller 17, the ribbon winding shaft 19 is rotated, and only the printing tape 26 is conveyed backwardly through a distance (step A6) which corresponds to the conveyance quantity counter in the RAM 92 counting down from its present count to zero based on the output signals from the tape position sensor 103.

The thermal head 16 is then pressed against the platen roller 17 through the ink ribbon 28 and the printing tape 26 for one line printing. In this state, the thermal head driver 98 causes the heaters of the thermal head 16 to produce heat in accordance with print data stored in the RAM 92 to thereby transfer the M ink of the ink, ribbon 28 to the printing tape 26. The step motor driver 99 then drives the step motor 71 to rotate the platen roller 17 and the ink ribbon winding shaft 21 to thereby convey the ink ribbon 28 and the tape 26 downstream to the next one-line printing position. In this way, the printing of one line by the thermal load 16 and downward conveyance of the ink ribbon 28 and the printing tape 26 are repeated such that the M color print data is printed lengthwise in the Y ink printed area on the tape 26 in superimposed relationship (step A7).

Subsequently, the head of the cyan C ink is detected (step A8). The tape 26 is backwardly conveyed upstream by the same quantity as the tape 26 was conveyed downstream in the Y and M ink printing processes (step A9).

The cyan ink print data is also printed in the same printing area of the tape 26 in superimposing relationship to, the yellow and magenta ink print data in a manner similar to those in which those data were printed (step A10).

When the cyan ink print data has been printed in superimposing manner, the step motor driver, 99 drives the step motor 71 to convey the tape 26 to thereby discharge its printed tape potion out of the printer (step A11). The DC motor driver 101 drives the DC motor 73 in this state to actuate the cutter 22 to cut the printed tape portion from the tape 26 (step A12).

While in the embodiment the printing tape 26 is, illustrated as having a plurality of N and S poles of a particular width alternately arranged longitudinally of the tape 26, the N and S poles are not required to be arranged regularly in an alternating manner. A single magnet may be provided instead whose. N or S pole has a strength changing over its length.

While in the embodiment the thermal transfer printer which uses a color ink ribbon has been illustrated, the present invention is also applicable to ink jet type color printers.

Since the tape printer senses changes in the magnetic characteristic of the printing tape to control the distance through which the printing tape is conveyed, print marks used for control of the conveyance distance may not be provided on the printing tape.

What is claimed is:

1. A printing tape cassette adapted to be set in a tape printer which includes a conveying mechanism and a printing unit having a thermal head, wherein:

(i) the printing tape cassette comprises:

a cassette case, a holding reel contained within the cassette case, and a printing tape wound around the holding reel and also contained within the cassette case;

(ii) the printing tape comprises:

a magnetic layer of magnetic powder magnetized widthwise of the printing tape such that a plurality of strip-like S and N magnetic poles extending across the printing tape are arranged alternately through a whole length of the printing tape, and a printing layer provided on the magnetic layer and on which characters/images are printed by the printing unit of the tape printer; and (iii) the printing tape is magnetically pastable to a ferromagnetic object by a magnetic force produced by the magnetic layer, and is contained within the cassette case so as to be drawable out of the cassette case and fed by the conveying mechanism of the tape printer from the cassette case to the printing unit of the tape printer.

2. The cassette according to claim 1, wherein a coated resin layer is provided on a side of the magnetic layer opposite to the printing layer for preventing small particles or grains of the magnetic layer from moving to the printing layer when the magnetic layer comes into contact with the printing layer due to the magnetic layer and the printing layer being wound around the holding reel.

3. The cassette according to claim 2, wherein the coated resin layer comprises a fluorine resin.

4. A cassette comprising a holding reel around which a printing tape that is magnetically affixable to an object is wound, wherein:

the cassette is settable in a tape printer that includes conveying means for conveying the tape of the cassette and printing means for printing characters/images on the tape, the tape comprises a printing layer on which characters/images are printed by the tape printer and a magnetic layer of magnetic powder that is magnetized widthwise of the tape, said magnetic layer being superposed on the printing layer, and a side of the magnetic layer opposite to the printing layer is wrinkled for preventing small particles or grains of the magnetic layer from moving to the printing tape layer when the magnetic layer comes into contact with the printing layer due to the magnetic layer and the printing layer being wound around the holding reel.

5. The cassette according to claim 1, further comprising a printing ink ribbon which contains a non-magnetic substance ink.

6. The cassette according to claim 1, wherein, the magnetic layer has a non-magnetic area formed along at least one edge of the tape.

7. A cassette comprising a holding reel around which a printing tape that is magnetically affixable to an object is wound, wherein:

the cassette is settable in a tape printer that includes conveying means for conveying the tape of the cassette and printing means for printing characters/images on the tape, the tape comprises a printing layer on which characters/images are printed by the tape printer and a magnetic layer of magnetic powder that is magnetized widthwise of the tape, said magnetic layer being superposed on the printing layer and the cassette further comprising comprises an auxiliary non-magnetic tape provided at a trailing end of the tape and bonded to the holding reel to such a degree that the auxiliary non-magnetic tape is separated from the holding reel by a conveying force exerted by the conveying means of the printer.

8. A cassette comprising a holding reel around which a printing tape that is magnetically affixable to an object is wound, wherein;

the cassette is settable in a tape printer that includes conveying means for conveying the tape of the cassette and printing means for printing characters/images on the tape, the tape comprises a printing layer on which characters/images are printed by the tape printer and a magnetic layer of magnetic powder that is magnetized widthwise of the tape, said magnetic layer being superposed on the printing layer, and the cassette further comprises an auxiliary non-magnetic tape provided at a trailing end of the tape and bonded to the holding reel to such a degree that the auxiliary non-magnetic tape is separated from the holding reel by a conveying force exerted, by the conveying means of the printer.

* * * * *